US009808852B2

(12) United States Patent
Frenken

(10) Patent No.: US 9,808,852 B2
(45) Date of Patent: Nov. 7, 2017

(54) HAND EXPANSION DEVICE

(71) Applicant: Gustav Klauke GmbH, Remscheid (DE)

(72) Inventor: Egbert Frenken, Heinsberg (DE)

(73) Assignee: GUSTAV KLAUKE GBMH (DE)

( * ) Notice: Subject to any disclaimer, the term of this patent is extended or adjusted under 35 U.S.C. 154(b) by 0 days.

(21) Appl. No.: 14/903,342

(22) PCT Filed: Jul. 9, 2014

(86) PCT No.: PCT/EP2014/064667
§ 371 (c)(1),
(2) Date: Jan. 7, 2016

(87) PCT Pub. No.: WO2015/004167
PCT Pub. Date: Jan. 15, 2015

(65) Prior Publication Data

US 2016/0332206 A1 Nov. 17, 2016

(30) Foreign Application Priority Data

Jul. 10, 2013 (DE) ..... 10 2013 107 294

(51) Int. Cl.
*B21D 41/02* (2006.01)
*B25F 5/00* (2006.01)

(52) U.S. Cl.
CPC ..... *B21D 41/028* (2013.01); *B25F 5/005* (2013.01)

(58) Field of Classification Search
CPC .... B21D 41/026; B21D 41/028; B21D 39/20; B21D 41/20; B21D 31/04; B21D 39/08; B25B 7/00; B25B 27/10; B25F 5/005
See application file for complete search history.

(56) References Cited

U.S. PATENT DOCUMENTS 2,999,529 A * 9/1961 Rast ..... B21D 39/20 72/393
4,034,591 A * 7/1977 Rothenberger ..... B21D 41/026 72/393

(Continued)

FOREIGN PATENT DOCUMENTS

DE 10247549 B3 5/2004
DE 102004046000 A1 3/2006

(Continued)

OTHER PUBLICATIONS

English Translation of equivalent Wagner DE 10247549 as EP1407838.*

(Continued)

*Primary Examiner* — R. K. Arundale
*Assistant Examiner* — Pradeep C Battula
(74) *Attorney, Agent, or Firm* — Klintworth & Rozenblat IP LLP

(57) ABSTRACT

A hand expansion device is capable of expanding pipe ends. The device includes an expanding head, which can be actuated by an electric motor and/or by a hydraulic medium and which has a plurality of segments. The segments can be actuated by an expanding mandrel that can be moved in the direction of a longitudinal axis of the expanding head. The segments are expanded in a direction which is transverse to the movement direction of the expanding mandrel as the result of a first triggering of an expansion process. A second activation of the hand expansion device is only allowed if it is determined that the hand expansion device was rotated around the longitudinal axis a predetermined angle.

10 Claims, 4 Drawing Sheets

(56) References Cited

U.S. PATENT DOCUMENTS 4,154,083 A * 5/1979 Rothenberger ..... B21D 41/026 72/393
4,425,783 A * 1/1984 Rast ..... B21D 41/026 72/393
4,890,472 A * 1/1990 Rothenberger ..... B21D 41/026 72/393
5,125,324 A * 6/1992 Araki ..... B25B 27/10 269/238
5,243,845 A * 9/1993 Velte ..... B21D 41/026 72/393
6,230,542 B1 5/2001 Frenken
6,276,186 B1 8/2001 Frenken
6,401,515 B2 6/2002 Frenken
7,065,995 B2 6/2006 Frenken
7,182,148 B1 * 2/2007 Szieff ..... B25B 21/00 173/171
7,325,436 B2 * 2/2008 Cheng ..... B21D 41/026 72/393
7,412,775 B1 * 8/2008 Karnick ..... G01C 19/38 33/316
7,447,565 B2 * 11/2008 Cerwin ..... B25F 5/022 700/279
9,327,337 B2 * 5/2016 Barthlein ..... B21D 41/028
2009/0008118 A1 * 1/2009 Frenken ..... B25D 9/12 173/221
2010/0308503 A1 * 12/2010 Schramm ..... B29C 57/04 264/312
2011/0291647 A1 * 12/2011 Lee ..... B25B 23/00 324/207.25
2012/0160065 A1 6/2012 Frenken

FOREIGN PATENT DOCUMENTS

DE 102008054455 A1 6/2010
DE 102012217179 A1 5/2013
DE 202012100361 U1 6/2013
DE 102012109255 A1 4/2014
EP 2402122 A2 1/2012

OTHER PUBLICATIONS

International Search Report dated Sep. 5, 2014 for PCT/EP2014/064667, seven pages with English translation.

* cited by examiner

HAND EXPANSION DEVICE

FIELD OF THE DISCLOSURE

The invention relates to a hand expansion device for expanding pipe ends with an expanding head that can be actuated by an electric motor and/or a hydraulic medium and features several segments, wherein these segments can be actuated by means of an expanding mandrel, which can be displaced the direction of a longitudinal axis the expanding head, and expanded by means of the expanding mandrel transverse to a displacement direction thereof as the result of a first activation of an expansion process.

BACKGROUND OF THE DISCLOSURE

Hand tools of the initially cited type can have various designs. They may be realized, for example, in the form of a hydraulic and/or electric pressing device, wherein we refer, e.g., to WO 99/19947 A1 (US 2012/0160065) in this respect. They may furthermore be realized in the form of an expansion device with an integrally designed expanding element, e.g., the form of an elastic sleeve, wherein we refer to the prior art according to WO 02/062504 A1 (U.S. Pat. No. 7,065,995 B2) in this respect.

Although the latter-mentioned expansion device already is an expansion device for expanding pipe ends, special hand expansion devices with the above-cited characteristics are furthermore known. In this respect, we refer, e.g., to the prior art according to non-prepublished German patent application 10 2012 109 255, as well as to U.S. Pat. No. 6,401,515B2, U.S. Pat. No. 6,276,186 B1 or U.S. Pat. No. 6,230,542 B1. We furthermore refer to DE 102 47 549B3.

EP 2 402 122 A2 discloses a nailing apparatus that features a position detection sensor. The activation of a nail setting process can be blocked in unfavorable positions of the nailing apparatus that should be detected with the aid of this sensor. DE 20 2012 100 361 U1 describes an expansion device of the type that can basically be considered as forming the basis of the invention.

In hand expansion devices of this type, it is frequently desired to carry out working processes in a certain sequence. In a hand expansion device, in particular, the expansion should be carried out multiple times, wherein the hand expansion device is each time turned about the longitudinal axis of the pipe, in which the expanding head of the expansion device is inserted for the expansion. This is intended to largely preclude imperfections over the circumference of the expansion.

To this end, aforementioned non-prepublished German patent application 10 2012 109 255 proposes that the expanding head automatically carries out a rotation about the aforementioned longitudinal axis after a first activation such that the desired turned position is reliably assumed when a second expansion process is activated. However, this is associated with a relatively high technical effort.

SUMMARY

Based on the prepublished prior art, the invention aims to disclose a hand expansion device which makes it possible to achieve a reliable sequence of actuations with a different spatial orientation of the device.

This objective is attained with the object of claim 1, according to which it is proposed that a second activation of an expansion process takes place if the hand expansion device (1) was moved about the longitudinal axis (L) after the first activation, that a sensor (7) for detecting a three-dimensional motion of the hand expansion device (1) is provided, and that a processing unit is provided in the device in order to evaluate signals of the sensor and to allow a control of the hand expansion device.

This makes it possible to advantageously realize the device for carrying out expansion processes with simple means, namely the aforementioned sensor and a processing unit that is preferably provided in the device and correspondingly evaluates the sensor signals, as well as a control of the hand expansion device in the described sense. The preceding explanations apply with respect to the arrangement of the sensor. However, since it is particularly important to detect the motion about the longitudinal axis in this case, the sensor can preferably also be arranged at a location of the tool, particularly of its housing, which is positioned at the greatest radial distance possible from the longitudinal axis. In a tool with the preferred angular design, in which an angled section is in its longitudinal extent penetrated by the longitudinal axis, about which the hand expansion device needs to be turned, for example, the sensor is preferably arranged in the end region of the other angled section that preferably also extends essentially perpendicular to the first angled section.

The aforementioned processing unit, e.g., in the form of a microprocessor and the connection to the device control as such preferably are also correspondingly provided in the hand tool as such.

Conventional sensors may be used as sensors for detecting a three-dimensional motion.

They may particularly consist of one or more so-called inertial sensors. The main especially consist of a MEMS (Micro-Electro-Mechanical-System) gyroscope. Sensors of this type are used, e.g., for the image stabilization of digital cameras or in input systems of video game consoles.

Such a sensor may particularly also be realized in the form of a vibrating structure gyroscope. It may likewise be arranged as a component on a circuit board in the interior of the hand tool or of the hand expansion device. For example, so-called "Dynamically Tuned Gyro" devices (DTG) may also be used for this purpose.

The three-dimensional motion, starting at which a further actuation of the hand expansion device is released, may correspond, e.g., to a motion about the aforementioned longitudinal axis of 2 degrees or more. For example, this rotational angle may be as large as 20 or 30 degrees. In this respect, a rotational angle between 8 and 15 degrees is particularly preferred.

It would alternatively or additionally also be possible that the second activation is only possible if the motion about the longitudinal axis has corresponded to one fourth or more, e.g. up to three-fourths, of an angular extent of a segment.

DESCRIPTION OF THE DRAWINGS

The invention is described in greater detail below with reference to the attached drawings that, however, merely show an exemplary embodiment. In these drawings.

DETAILED DESCRIPTION

Figure 1:
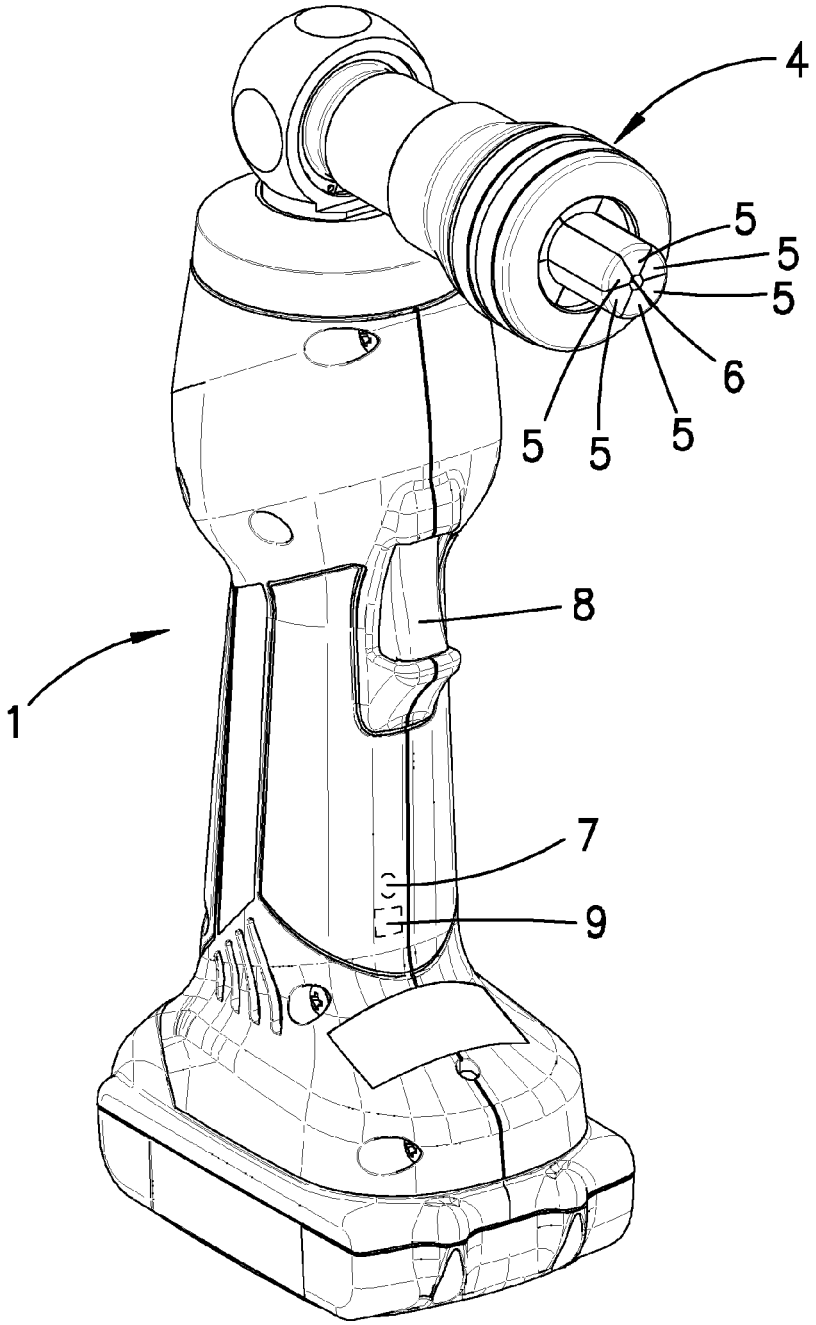
FIG. 1 shows a hand expansion device in the form of a perspective view.
Figure 2:
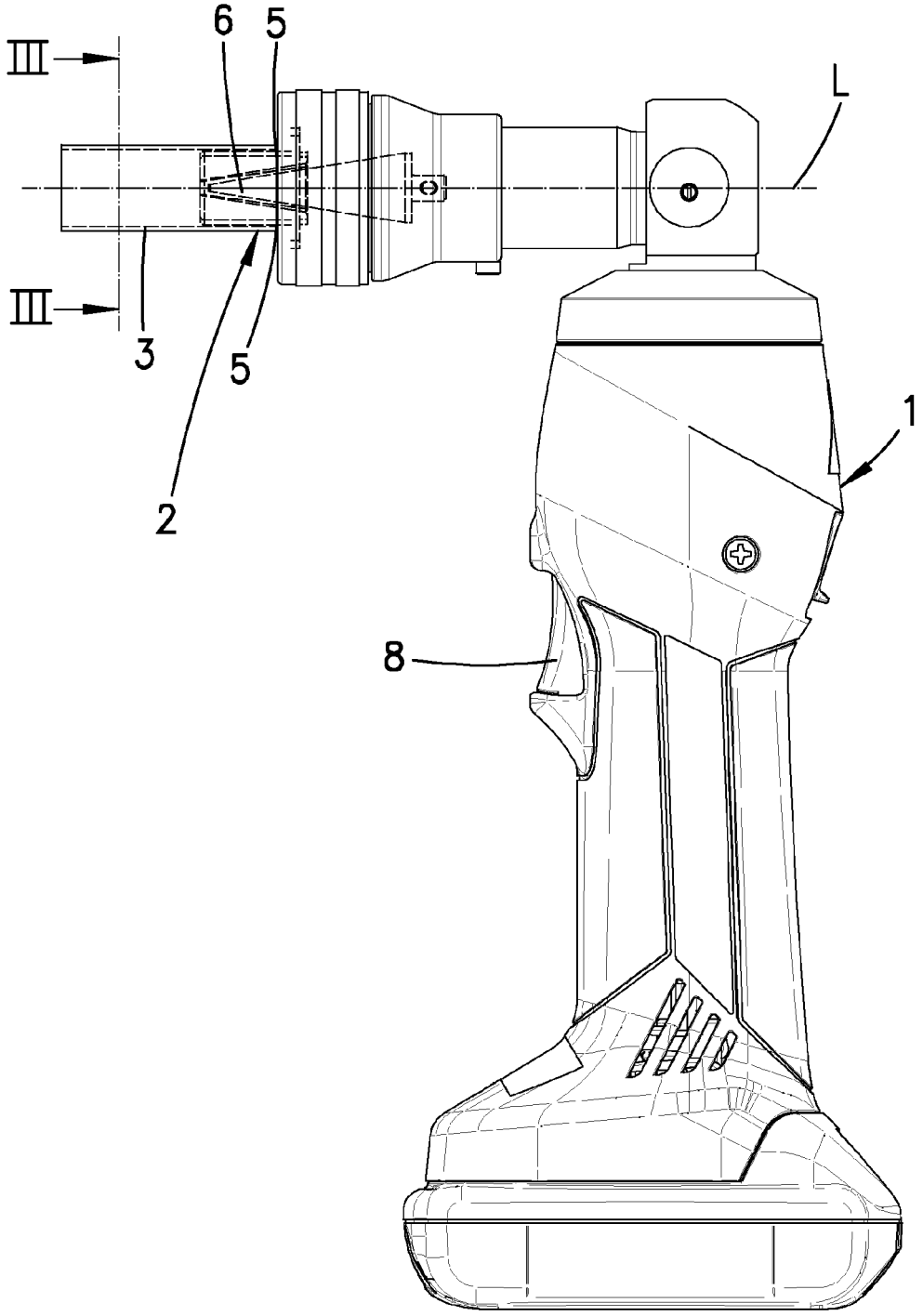
FIG. 2 shows a side view of the hand expansion device according to FIG. 1 in connection with a pipe to be expanded.

A hand expansion device 1 suitable for expanding one end 2 of a pipe 3 is illustrated in the figures and described below.

Such an expansion of pipe ends is required, in particular, in the plumbing trade. It must be carried out, e.g., in order to push a pipe, particularly a plastic pipe or, e.g., a composite aluminum pipe, onto a connector and/or to press-fit an expanded pipe with another non-expanded pipe inserted therein.

The hand expansion device features an expanding head 4 composed of several individual segments 5 that can be actuated by means of a displaceable expanding mandrel 6.

The individual segments are circularly arranged transverse to a displacement direction of the expanding mandrel 6 that corresponds to a longitudinal axis L of the expanding head 4.

The segments 5 are forced outward as the result of an activation of an expansion process by means of the expanding mandrel, during which the expanding mandrel 6 is displaced outward referred to the expanding head 4 in the direction of the longitudinal axis for the expansion process, and thereby cause the expansion of the end 2 of the pipe 3.

In the hand expansion device shown, a schematically indicated sensor 7 is provided for detecting a three-dimensional motion of the hand expansion device. When an expansion process of the hand expansion device is activated, e.g., by means of an actuating switch 8, this can be interpreted as a first activation.

Figure 3:
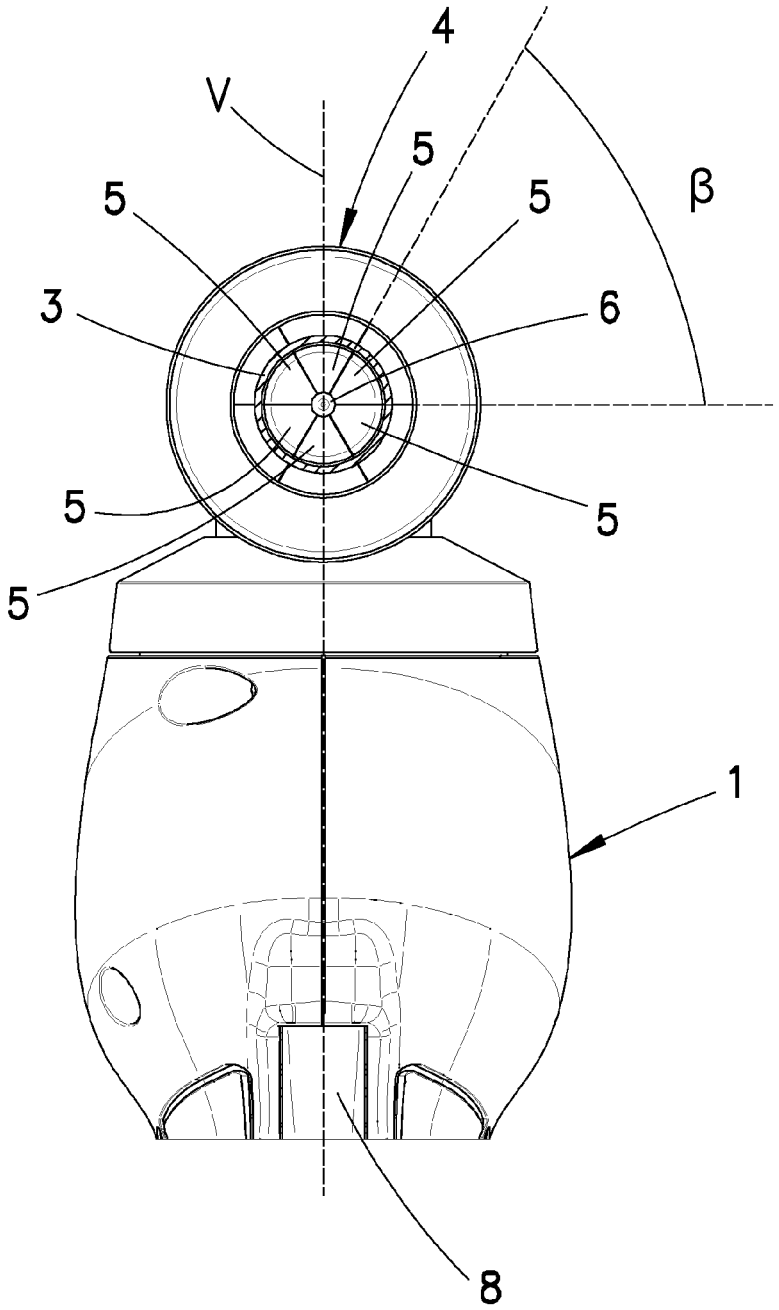
FIG. 3 shows a cross section through the object according to FIG. 2 along the plane III-III.
Figure 4:
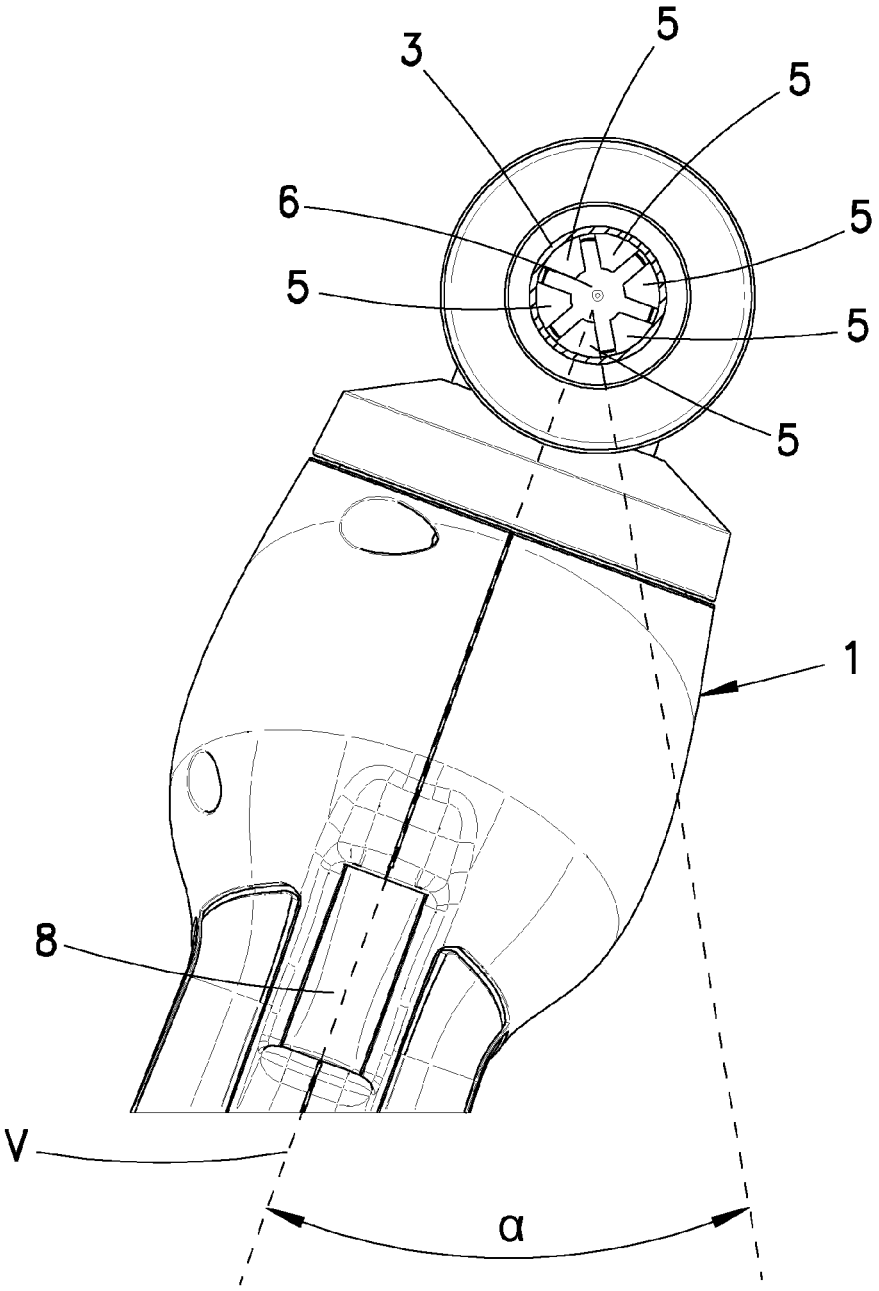
FIG. 4 shows an illustration according to FIG. 3 after the rotation of the hand expansion device about the longitudinal axis has taken place.

In the device shown, a second activation of an expansion process is only possible if the hand expansion device was after the first activation turned about the longitudinal axis L, see FIGS. 3 and 4, by a certain angle a. In this context, FIG. 3 particularly shows the state, in which the expanding mandrel 6 is not yet moved forward or was moved back again after its initial forward motion (and the associated first expansion process), whereas FIG. 4 shows the state, in which the expansion mandrel is (once again) moved forward and has caused a (second) expansion.

With respect to the circuit technology, the sensor 7 is furthermore connected to a control unit 9 that preferably is arranged in the hand expansion device 1 itself, but only schematically indicated in the figures.

The angle a may vary. It preferably corresponds to approximately half of an identically measured angle β of a segment 5. In this way, it can be ensured that clearances resulting between the individual segments are during the second activation of an expansion process reliably covered by a segment 5 as the result of their radial motion.

It is particularly preferred that the angle a corresponds to one fourth or more, e.g. up to three-fourths, of an angular extent of the segment 5 referred to a circumferential angle about the longitudinal axis L.

It would additionally or alternatively also be possible to monitor if after the first activation the hand expansion device 1 was not moved in the direction of the longitudinal axis L. In this case, a second activation can only be realized, e.g., if the device is still or, after the first activation, once again in its corresponding position in the direction of the longitudinal axis L. A certain tolerance may also be provided in this respect. This tolerance may lie, e.g., in the range between 1 and 5 mm.

The invention claimed is:

1. A hand expansion device capable of expanding pipe ends comprising:

an expanding head configured to be actuated by an electric motor and/or a hydraulic medium, the expanding head defining a longitudinal axis, wherein the hand expansion device is capable of rotating around the longitudinal axis;

an expanding mandrel on the expanding head, the expanding mandrel configured to be displaced in a displacement direction along the longitudinal axis of the expanding head;

a plurality of segments on the expanding head, the segments configured to be expanded by the expanding mandrel transverse to the displacement direction of the expanding mandrel to affect an expansion process;

a sensor on the hand expansion device capable of detecting a three-dimensional motion of the hand expansion device and to generate signals relating to the three-dimensional motion of the hand expansion device;

a switch, wherein the hand expansion device is configured to be actuated by the switch to affect a first expansion process such that the segments expand transverse to the displacement direction of the expanding mandrel in response to movement by the expanding mandrel; and a processing unit associated with the hand expansion device, the processing unit in communication with the sensor and the switch, the processing unit receives and evaluates the signals generated by the sensor of the detected three-dimensional motion of the hand expansion device;

wherein, if and only if the processing unit determines from the signals of the sensor that the hand expansion device was rotated around the longitudinal axis a predetermined angle, then the processing unit allows a second activation of the switch of the hand expansion device to affect a second expansion process, wherein the segments expand transverse to the displacement direction of the expanding mandrel in response to a movement by the expanding mandrel.

2. The hand expansion device according to claim 1, wherein each segment defines a circumferential angular extent, and wherein the predetermined angle corresponds to one fourth or more of the circumferential angular extent of one of the segments.

3. The hand expansion device according to claim 1, wherein each segment defines a circumferential angular extent, and wherein the predetermined angle corresponds to one fourth to three-fourths the circumferential angular extent of one of the segments.

4. The hand expansion device according to claim 1, wherein the sensor comprises an inertial sensor.

5. The hand expansion device according to claim 1, wherein the sensor comprises a Micro-Electro-Mechanical-System gyroscope.

6. The hand expansion device according to claim 1, wherein the sensor comprises a vibrating structure gyroscope.

7. The hand expansion device according to claim 1, wherein the sensor is provided on a circuit board in an interior of the hand expansion device.

8. The hand expansion device according to claim 1, wherein the predetermined angle is 2 degrees or greater.

9. The hand expansion device according to claim 1, wherein the predetermined angle is 20 degrees.

10. The hand expansion device according to claim 1, wherein the predetermined angle is 30 degrees.

* * * * *